US008454138B2

(12) United States Patent
Tamaki

(10) Patent No.: US 8,454,138 B2
(45) Date of Patent: Jun. 4, 2013

(54) LIQUID EJECTING APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 104 days.

(21) Appl. No.: 13/046,661

(22) Filed: Mar. 11, 2011

(65) Prior Publication Data

US 2011/0234713 A1 Sep. 29, 2011

(30) Foreign Application Priority Data

Mar. 29, 2010 (JP) ..... 2010-074029

(51) Int. Cl.
*B41J 2/175* (2006.01)

(52) U.S. Cl.
USPC ..... 347/85

(58) Field of Classification Search
None
See application file for complete search history.

(56) References Cited

U.S. PATENT DOCUMENTS

| | | | | |
|---|---|---|---|---|
| 4,496,959 | A * | 1/1985 | Frerichs | 347/86 |
| 5,039,999 | A * | 8/1991 | Winslow et al. | 347/85 |
| 5,055,861 | A | 10/1991 | Murayama et al. | |
| 6,598,963 | B1 * | 7/2003 | Yamamoto et al. | 347/85 |
| 6,722,762 | B2 * | 4/2004 | Miyazawa et al. | 347/86 |
| 7,290,861 | B2 * | 11/2007 | Inoue et al. | 347/49 |
| 7,669,961 | B2 * | 3/2010 | Silverbrook et al. | 347/29 |
| 2001/0015742 | A1 * | 8/2001 | Childers | 347/85 |
| 2003/0007049 | A1 * | 1/2003 | Hino | 347/92 |
| 2003/0122907 | A1 * | 7/2003 | Kim | 347/86 |
| 2003/0128257 | A1 * | 7/2003 | Qingguo et al. | 347/85 |
| 2005/0168547 | A1 * | 8/2005 | Yoshiyama et al. | 347/86 |
| 2005/0174408 | A1 * | 8/2005 | Qingguo et al. | 347/97 |
| 2005/0195254 | A1 * | 9/2005 | Takagi et al. | 347/85 |
| 2006/0007277 | A1 * | 1/2006 | Lai | 347/85 |
| 2007/0200904 | A1 * | 8/2007 | Wilson et al. | 347/85 |
| 2007/0242112 | A1 * | 10/2007 | Yazawa | 347/85 |
| 2008/0049063 | A1 * | 2/2008 | Nakamura et al. | 347/20 |
| 2008/0055374 | A1 * | 3/2008 | Yahiro | 347/85 |
| 2008/0136864 | A1 * | 6/2008 | Nakamura et al. | 347/30 |
| 2008/0204501 | A1 * | 8/2008 | Kurita et al. | 347/17 |
| 2008/0231671 | A1 * | 9/2008 | Lee et al. | 347/85 |
| 2008/0273046 | A1 * | 11/2008 | Ishinaga et al. | 347/6 |
| 2009/0147047 | A1 * | 6/2009 | Hayashi | 347/36 |

FOREIGN PATENT DOCUMENTS

| | | | |
|---|---|---|---|
| JP | H02-179759 | A | 7/1990 |
| JP | 2000-352379 | A | 12/2000 |
| JP | 2003-094681 | A | 4/2003 |
| JP | 2004-230652 | A | 8/2004 |
| JP | 2007-105929 | A | 4/2007 |

OTHER PUBLICATIONS

Japan Patent Office, Notification of Reasons for Refusal for Japanese Patent Application No. 2010-074029 (counterpart to above-captioned patent application), dispatched Mar. 21, 2012.

* cited by examiner

*Primary Examiner* — Matthew Luu
*Assistant Examiner* — Patrick King
(74) *Attorney, Agent, or Firm* — Baker Botts L.L.P.

(57) ABSTRACT

A liquid ejecting apparatus including a liquid-ejecting head for ejecting a liquid, a tank for storing the liquid to be supplied to the liquid-ejecting head, and a liquid supply portion configured to supply the liquid from the tank to the liquid-ejecting head, wherein the tank includes an inner wall structure which is enclosed within an outer wall of the tank and which defines therein an inner liquid flow space which communicates with the liquid supply portion and through which the liquid is supplied from the liquid supply portion to the liquid-ejecting head.

9 Claims, 7 Drawing Sheets

LIQUID EJECTING APPARATUS

CROSS REFERENCE TO RELATED APPLICATION

The present application claims the priority from Japanese Patent Application No. 2010-074029 filed Mar. 29, 2010, the disclosure of which is herein incorporated by reference in its entirety.

BACKGROUND OF THE INVENTION

1. Field of the Invention

The present invention relates to a liquid ejecting apparatus configured to eject droplets of a liquid such as an ink.

2. Description of Related Art

An ink-jet printer known as an example of a liquid ejecting apparatus has a main tank and an auxiliary tank (serving as a liquid supply tank) which stores an ink and wherein the ink is supplied from the auxiliary tank to each ink-jet head while the ink is fed from the main tank to the auxiliary tank as needed. The auxiliary tank is used not only during a printing operation of the ink-jet head, but also during purging operations (recovering operations) of the ink-jet head. During the purging operations, the ink is supplied from the auxiliary tank to the ink-jet head, and the ink is ejected from all ink-ejecting nozzles, together with foreign matters such as air bubbles. The purging operations include a circulation purging operation wherein a pump is operated to feed the ink from the auxiliary tank to the ink-jet head, circulate the ink through predetermined passages in the ink-jet head, and return the ink to the auxiliary tank, together with the air bubbles and other foreign matters, so that the foreign matters remaining in ink passages in the ink-jet head is removed from the ink-jet head.

SUMMARY OF THE INVENTION

During the purging operations of the ink-jet head described above, a relatively high pressure of the ink pressurizing by the operation of the pump applies to an ink supply tube. Where ink-ejecting nozzles of the ink-jet head are clogged with the ink or where a phenomenon of pressure pulsation of the pump takes place, the ink pressure may exceed a critical value, giving rise to a problem of damage or breakage of the ink supply tube, and consequent leakage of the ink from the ink supply tube.

The present invention was made in view of the background art described above. It is therefore an object of the present invention to provide a liquid ejecting apparatus which is configured to prevent leakage of a liquid from the apparatus.

The object indicated above can be achieved according to the principle of this invention, which provides a liquid ejecting apparatus comprising: a liquid-ejecting head configured to eject a liquid; a tank which stores the liquid to be supplied to the liquid-ejecting head; and a liquid supply portion configured to supply the liquid from the tank to the liquid-ejecting head, and wherein the tank includes an inner wall structure which is enclosed within an outer wall of the tank and which defines therein an inner liquid flow space which communicates with the liquid supply portion and through which the liquid is supplied from the liquid supply portion to the liquid-ejecting head.

BRIEF DESCRIPTION OF THE DRAWINGS

The above and other objects, features, advantages and technical and industrial significance of the present invention will be better understood by reading the following detailed description of a preferred embodiment of the present invention, when considered in connection with the accompanying drawings, in which:

FIG. 6A is a front elevational view showing the auxiliary tank with its outer lid removed, while

DETAILED DESCRIPTION OF THE PREFERRED EMBODIMENT

The preferred embodiment of this invention will be described by reference to the accompanying drawings.

Figure 1:
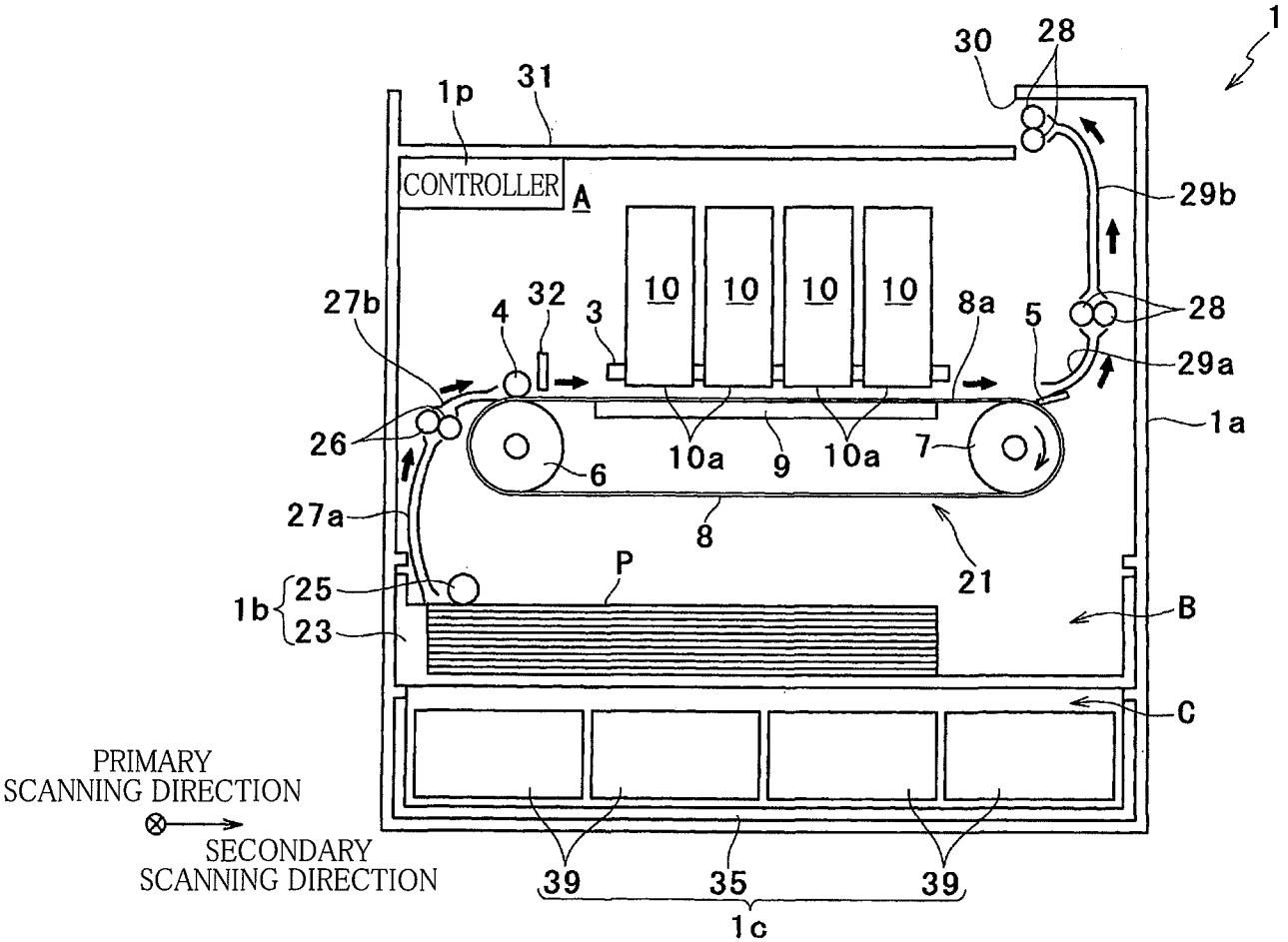
FIG. 1 is a schematic side elevational view of an ink-jet type printer including an ink-jet head as a liquid-ejecting head constructed according to one embodiment of this invention.

Referring first to the schematic side elevational view of FIG. 1, there is shown a printer 1 constructed as a liquid ejecting apparatus constructed according to the preferred embodiment of the present invention.

The printer 1 has a housing 1*a* in the form of a generally rectangular parallelepiped having an upper wall that serves as a sheet receiver 31. The housing 1*a* has three functional spaces A, B and C arranged in the order of description in the downward direction. A sheet transfer path along which a sheet of paper P is fed is formed through the functional spaces A and B and leads to the sheet receiver 31. In the functional space C, four main tanks 39 are disposed as ink supply sources for respective liquid-ejecting heads in the form of ink-jet heads 10.

In the functional space A, there are disposed the above-described four ink-jet heads 10, a sheet transfer unit 21 for transferring the paper sheet P, and sheet guide devices for guiding the paper sheet P. In an upper part of the functional space A, there is disposed a controller 1*p* for controlling operations of various devices of the printer 1.

The controller 1*a* controls a printing operation to feed the paper sheet P and eject droplets of an ink from the ink-jet heads 10 in synchronization of the feeding motion of the paper sheet P, according to image data received from an external device, and various maintenance operations for maintaining and recovering the performance of ink ejection from the ink-jet heads 10. The maintenance operations include purging operations of the ink-jet heads 10, which will be described.

The sheet transfer unit 21 includes two belt rollers 6, 7, an endless conveyor belt 8 connecting the two belt rollers 6, 7, a nip roller 4 disposed adjacent to the belt roller 6, a sheet separator plate 5 disposed adjacent to the belt roller 7, and a platen 9 disposed within the loop of the conveyor belt 8. The belt roller 7 is a drive roller rotated clockwise as seen in FIG. 1 by a belt drive motor (not shown). As a result of the clockwise rotation of the belt roller 7, the upper span of the conveyor belt 8 is moved rightwards as indicated by thick-line arrows in FIG. 1. The belt roller 6 is a driven roller rotated clockwise as the conveyor belt 8 is rotated by the belt roller 7.

The nip roller 4 disposed adjacent to the belt roller 6 cooperates with the belt roller 6 to press the paper sheet P onto an outer surface 8*a* of the conveyor belt 8 as the paper sheet P is fed from an upstream sheet guide device (described below). The paper sheet P is fed toward the belt roller 7 with a rotary motion of the conveyor belt 8 while the paper sheet P is supported in contact with the outer surface 8*a* of the conveyor belt 8. The sheet separator plate 5 disposed adjacent to the belt roller 7 functions to separate the paper sheet P from the outer surface 8*a*, so that the paper sheet P is fed toward a downstream sheet guide device (described below). The platen 9 is disposed below and in opposition to the four ink-jet heads 10, and functions to support the upper span of the conveyor belt 8 on its inner surface.

Each ink-jet head 10 has a housing in the form of a generally rectangular parallelepiped the longitudinal direction of which is parallel to a primary scanning direction indicated in FIG. 1. The ink-jet head 10 has a lower ink-ejecting surface 10*a* in which a multiplicity of ink-ejecting nozzles 14*a* (shown in FIGS. 4 and 5) are open. During the printing operations, the four ink-jet heads 10 are supplied with respective four colors of ink, namely, magenta, cyan, yellow and black inks, and are configured to eject droplets of the respective colors of ink from their ink-ejecting surfaces 10*a* toward the paper sheet P. The four ink-jet heads 10 are arranged at a predetermined pitch in a secondary scanning direction also indicated in FIG. 1, and are supported by the housing 1*a* via a head holder 3, such that the ink-ejecting surfaces 10*a* of the ink-jet heads 10 are opposed to the outer surface 8*a* of the upper span of the conveyor belt 8, and such that an amount of gap suitable for the printing operations is left between the ink-ejecting surfaces 10*a* and the outer surface 8*a*.

The upstream and downstream sheet guide devices are disposed on the respective opposite sides of the sheet transfer unit 21. The upstream sheet guide device includes two guides 27*a*, 27*b*, and a pair of feed rollers 26, and functions to guide the paper sheet P from a sheet supply unit 1*b* (described below) to the sheet transfer unit 21. The downstream sheet guide device includes two guides 29*a*, 29*b*, and a pair of feed roller 28, and functions to guide the paper sheet P from the sheet transfer unit 21 to the sheet receiver 31.

In the functional space B, there is disposed the above-indicated sheet supply unit 1*b* such that the sheet supply unit 1*b* is removable from the housing 1*a*. The sheet supply unit 1*b* includes a sheet supply tray 23 and a sheet supply roller 25. The sheet supply tray 23 is a box having an upper opening, and is configured to accommodate a stack of paper sheets P of a selected one of different sizes. The sheet supply roller 25 is driven by a sheet supply motor (not shown) to feed the uppermost paper sheet P of the stack toward the upstream sheet guide device.

In the functional spaces A and B, a sheet transfer path is formed so as to extend from the sheet supply unit 1*b* to the sheet receiver 31 through the sheet transfer unit 21. The above-indicated belt drive motor and sheet supply motor and motors (not shown) for the feed rollers 26, 28 are driven under the control of the controller 1*p* according to printing control commands received from an external device, so that the uppermost paper sheet P is fed by the sheet supply roller 25 from the sheet supply tray 523, fed by the feed rollers 26 to the sheet transfer unit 21, and fed by the conveyor belt 8 under the ink-ejecting surfaces 4*a* of the ink-jet heads 10 in the secondary scanning direction while the ink droplets are ejected from the ink-ejecting surfaces 4*a*, whereby the desired color images are printed on the paper sheet P. The ejection of the ink droplets from the ink-ejecting surfaces 4*a* is initiated on the basis of an output signal of a sheet sensor 32. Subsequently, the paper sheet P is separated by the sheet separator plate 5 from the outer surface 8*a* of the conveyor belt 8, and is fed upwards by the pair of feed rollers 28 while the paper sheet P is guided by the guides 29*a*, 29*b*, and is ejected onto the sheet receiver 31.

The secondary scanning direction is a horizontal direction parallel to the direction of feeding of the paper sheet p by the sheet transfer unit 21, while the primary scanning direction is a horizontal direction perpendicular to the secondary scanning direction.

In the functional space C, there is disposed an ink unit 1*c* such that the ink unit 1*c* is removable from the housing 1*a*. The ink unit 1*c* includes a tank tray 35, and the above-indicated four main tanks 39, which are arranged in the tank tray 35 in the secondary scanning direction.

Figure 2:
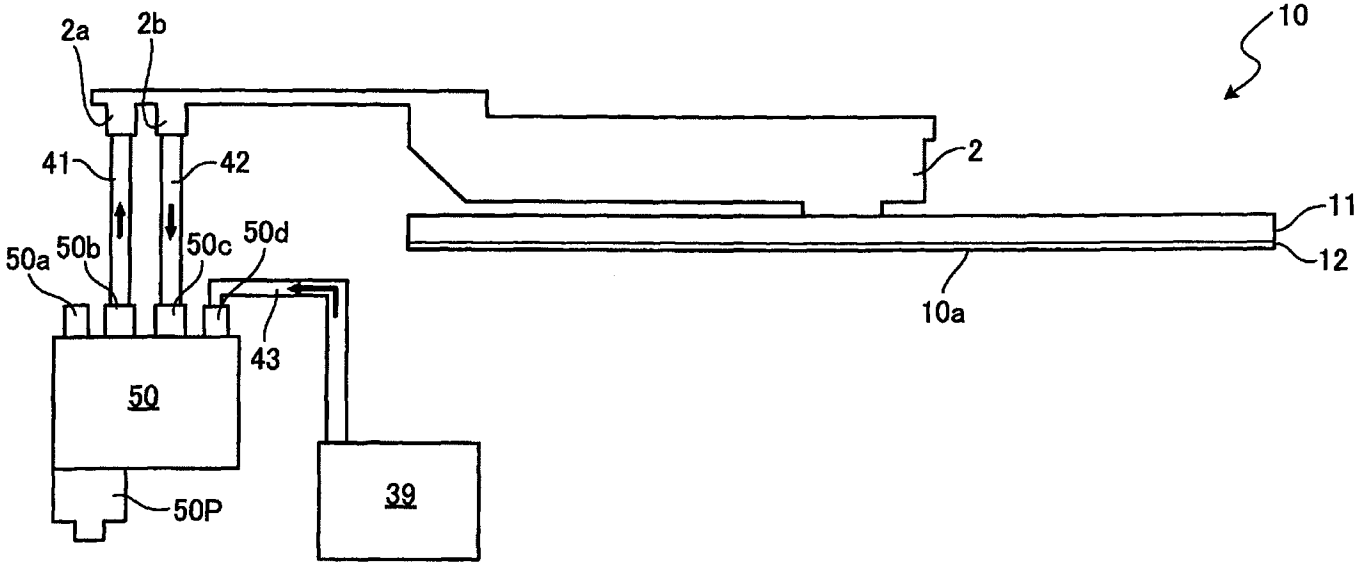
FIG. 2 is a schematic side elevational view of the printer of FIG. 1, showing an arrangement of connection of the ink-jet head to a main tank and an auxiliary tank.

Referring nest to FIG. 2, the construction of each ink-jet head 10, and the connections of the ink-jet head 10 to the main tanks 39 and an auxiliary tank 50 will be described.

As shown in FIG. 2, the ink-jet head 10 includes a filter unit 2, a reservoir unit 11 and a passage unit 12, which are arranged in the order of description in the downward direction. The filter unit 2 is a one-piece structure which is formed of a suitable material such as a synthetic resin and which has ink flow passages, and a filter (not shown). Each of the reservoir unit 11 and passage unit 12 consists of a plurality of rectangular metal plates which have through-holes and recesses and which are superposed on each other and fixed together, such that the through-holes and recesses form ink flow passages. The ink flow passages formed in the reservoir unit 11 include a reservoir which temporarily stores the ink fed from the filter unit 2. The ink flow passages formed in the passage unit 12 include individual ink passages 14 (shown in FIG. 5) communicating with the respective ink-ejecting nozzles 14*a*. The filter, reservoir and passage units 2, 11, 12 are fixed together such that the ink flow passages in the units 2, 11, 12 are held in communication with each other. The filer unit 2 and the reservoir unit 11 are fluid-tightly fixed together via O-rings of an elastic material by means of screws or other suitable fixing means. The reservoir unit 11 and the passage unit 12 are bonded together with a bonding agent.

The filter unit 2 has two joints 2*a* and 2*b* in one of opposite longitudinal end portions. These joints 2*a*, 2*b* take the form of sleeves extending downwards. The ink flow passages in the filter unit 2 are held in communication with the auxiliary tank 50 through elastic tubes 41, 42 connected to the respective joints 2*a*, 2*b*.

The main and auxiliary tanks 39, 50 have internal spaces for storing the ink, and are connected together through an elastic tube 43. The auxiliary tank 50 is replenished with the ink supplied from the main tank 39 as the ink in the auxiliary tank 50 is consumed. The auxiliary tank 50 is disposed at a suitable position within the housing 1*a*.

Figure 6B:
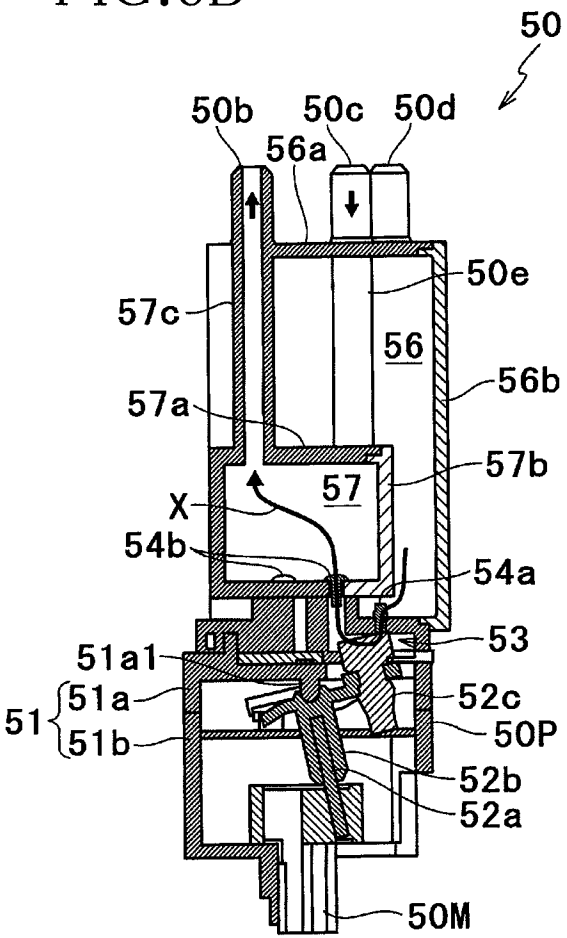
FIG. 6B is a cross sectional view taken along line 6B-6B of FIG. 6A.
Figure 6A:
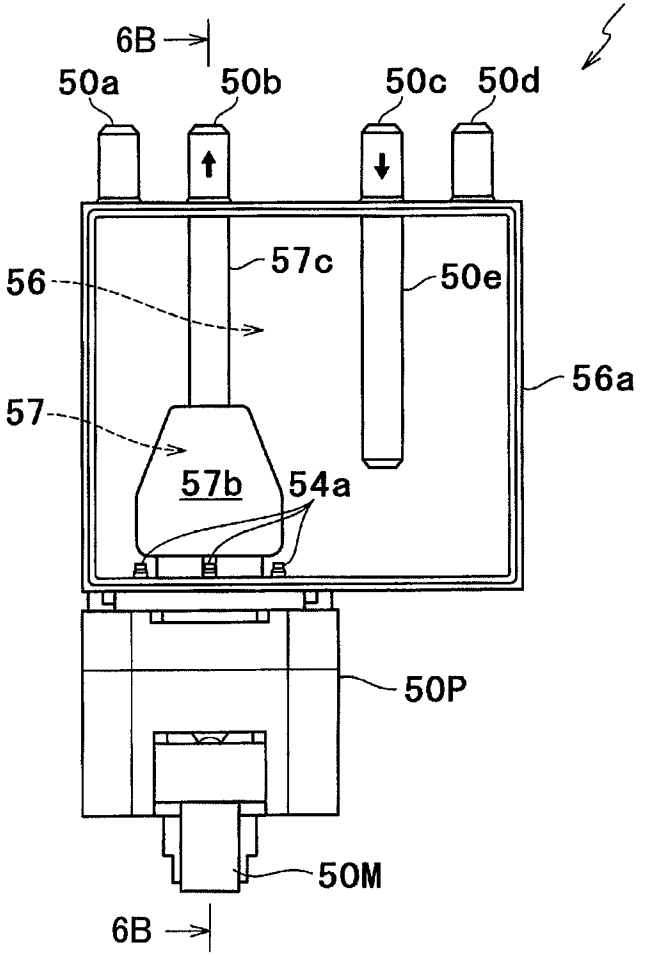

The auxiliary tank 50 has four projecting sleeves 50*a*, 50*b*, 50*c* and 50*d* formed upright on its upper wall (on the upper surface of its outer housing 56*a* shown in FIG. 6A). The projecting sleeves 50*b*, 50*c* and 50*d* are connected to the respective elastic tubes 41, 42 and 43 so that the internal space of the auxiliary tank 50 is held in communication with the joint 2*a*, joint 2*b* and auxiliary tank 39 through the respective projecting sleeves 50*b*, 50*c*, 50*d* and through the respective elastic tubes 41-43. However, the projecting sleeve 50*a* is not connected to any elastic tube, so that the internal space of the auxiliary tank 50 is exposed to the atmosphere through the projecting sleeve 50*a*, for removal of air bubbles contained in the ink.

To the lower wall (to the lower surface of the outer housing 56*a*) of the auxiliary tank 50, there is fixed a liquid supply portion in the form of a pump 50*p* which is electrically connected to the controller 1*p* (shown in FIG. 1). The elastic tubes 41-43 are provided with respective control valves. During purging operations of the ink-jet head 10, the pump 50*p* and the control valves are controlled by the controller 1*p* so that the ink is supplied from the auxiliary tank 50 into the filter unit 2 through the elastic tube 41, by an operation of the pump 50*p*.

The purging operations include a nozzle purging operation to eject the ink droplets from all of the ink-ejecting nozzles 14*a* by pressurizing the ink within the ink-jet head 10, and a circulation purging operation to introduce the ink into the filter unit 2 for removing foreign matters such as air bubbles accumulated on the upstream side of the filter, into the auxiliary tank 50, together with the ink. The nozzle purging operation is performed to eject the ink having a relatively high degree of viscosity, from the ink-ejecting nozzles 14*a*, for recovering the ink ejecting function of the ink-jet head 10. The circulation purging operation is performed to remove or prevent clogging of the filter in the filter unit 2. During the nozzle purging operation, the ink is sucked from the auxiliary tank 50, and is pump-pressurized and fed into the filter unit 2 through the elastic tube 41, as indicated above. During the circulation purging operation, the pressuring ink is fed through the elastic tube 41 into the filter unit 2 as in the nozzle purging operation, and the ink containing the foreign matters is returned back into the auxiliary tank 50 through the elastic tube 42.

The construction of the auxiliary tank 50 will be described in detail.

Figure 3:
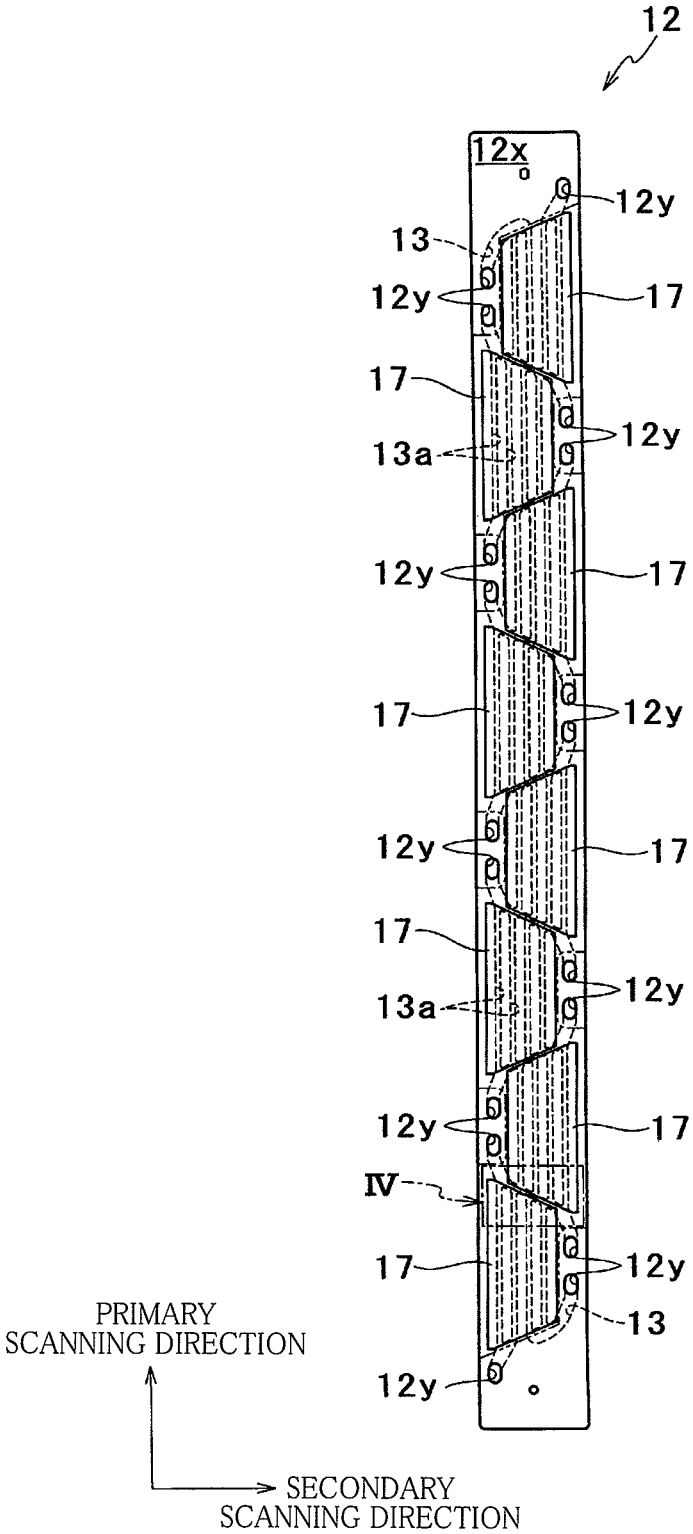
FIG. 3 is a plan view of a passage unit and actuator units of the ink-jet head.
Figure 4:
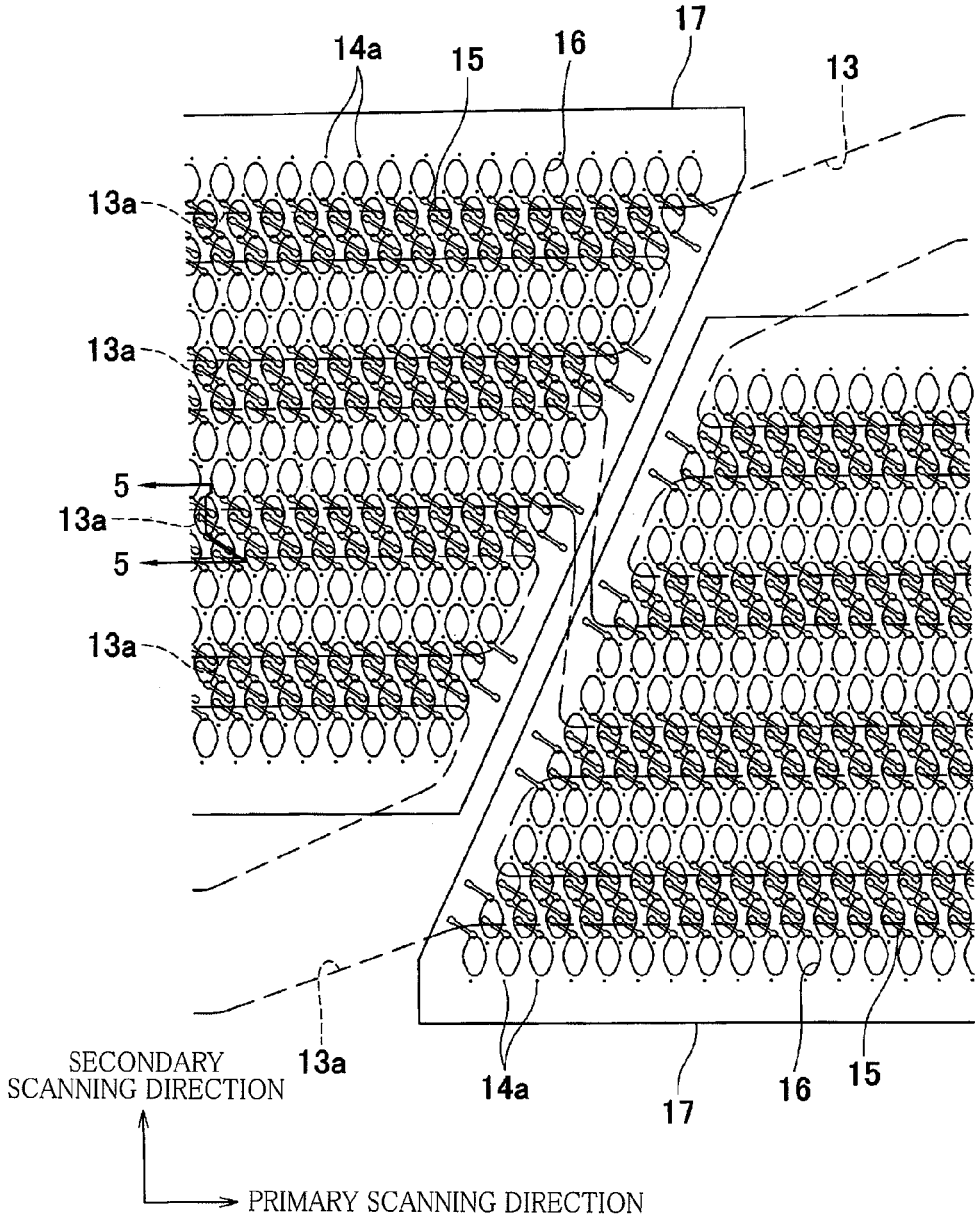
FIG. 4 is an enlarged view of an area IV indicated by one-dot chain line in FIG. 3.
Figure 5:
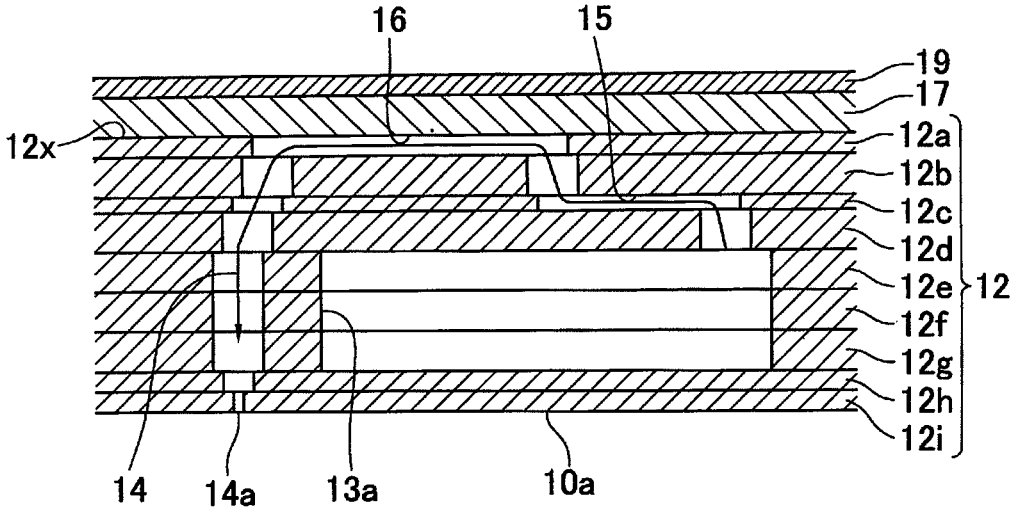
FIG. 5 is a fragmentary cross sectional view taken along line 5-5 of FIG. 4.

Referring next to FIGS. 3-5, the construction of each ink-jet head 10 will be described in detail. Regarding FIG. 4, it is noted that pressure chambers 16 and apertures which are located below actuator units 17 and should be shown by broken lines in FIG. 4 are shown by solid lines in the figure.

As shown in FIG. 3, the eight actuator units 17 are fixed to an upper surface 12*x* of the passage unit 12. A flexible printed circuit (FPC) 19 is fixed to each of the actuator units 17, as shown in FIG. 5.

The reservoir unit 11 (shown in FIG. 2) has recessed and raised portions formed on its lower surface, and is bonded in the raised portions of its lower surface to areas (indicated by two-dot chain lines in FIG. 3) of the upper surface 12*x* of the passage unit 12 in which the actuator units 17 are not disposed, but through-holes 12*y* are formed as shown in FIG. 3. With the reservoir unit 11 thus bonded to the passage unit 12, the recessed portions of the reservoir unit 11 are opposed to the upper surface 12*x* of the passage unit 12, the surfaces of the actuator units 17 and flexible printed circuit 19, with a small amount of gap left therebetween. The raised portions have through-holes formed through their end faces such that the through-holes are held in communication with the reservoir and opposed to the through-holes 12*y* of the passage unit 12, so that the reservoir in the reservoir unit 11 is held in communication with the individual ink passages 14 through the through-holes formed through the raised portions of the reservoir unit 11.

As shown in FIG. 5, the passage unit 12 is a laminar structure consisting of nine rectangular metal plates 12*a*-12*i* of almost the same size superposed on and bonded to each other. As shown in FIGS. 3-5, the ink flow passages formed in the passage unit 12 include main manifold passages 13 each having the through-hole 12*y* at its one end, auxiliary manifold passages 13*a* branching from each of the main manifold passages 13, and the above-indicated individual ink flow passages 14 extending from respective outlets of the auxiliary manifold passages 13*a* to the respective ink-ejecting nozzles 14*a* through respective pressure chambers 16. As shown in FIG. 5, each of the individual ink flow passages 14 includes an aperture 15 functioning as a throttle for adjusting a resistance of flow of the ink through the individual ink flow passage 14. In the areas of the upper surface 12*x* in which the actuator units 17 are bonded, there are formed rhombic openings arranged in a matrix fashion, such that the pressure chambers 16 are partially defined by the actuator units 17 through the openings. In the areas of the lower ink-ejecting surface 10*a* which correspond to the areas of the actuator units 17, there are formed the lower ink-ejecting nozzles 14*a* in a matrix fashion.

The actuator units 17 each of which has a trapezoidal shape as shown in the plan view of FIG. 3 are disposed on the upper surface 12*x* of the passage unit 12 in a zigzag fashion, as shown in the same figure. A group of a multiplicity of pressure chambers 16 is partially defined by each actuator unit 17. Each actuator unit 17 has a plurality of piezoelectric layers extending over the multiplicity of pressure chambers 16, and electrodes between which the piezoelectric layers are sandwiched in the direction of thickness of the piezoelectric layers. The electrodes include individual electrodes corresponding to the respective pressure chambers 16, and a common for all of the pressure chambers 16. The individual electrodes are formed on the surface of the uppermost piezoelectric layer. Thus, the actuator units 17 include piezoelectric actuators corresponding to the respective ink-ejecting nozzles 14*a*.

The flexible printed circuit 19 has wirings corresponding to the electrodes of the actuator units 17. The wirings are connected to a drive IC (not shown). The flexible printed circuit 19 is connected at one of its opposite ends to the actuator units 17, and at the other end to a control board (not shown; disposed above the reservoir unit 11) of the ink-jet head 10. The flexible printed circuit 19 functions to apply various drive signals from the control board to the drive IC, under the control of the controller 1*p* (FIG. 1), and applies signals generated by the driver IC to the actuator units 17.

Figure 7:
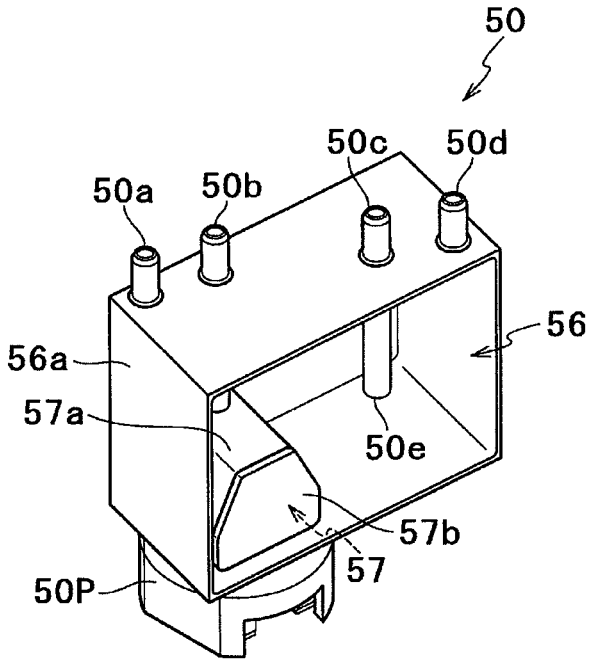
FIG. 7 is a perspective view showing the auxiliary tank with its outer lid removed.

The construction of the auxiliary tank 50 will be described in detail by reference to FIGS. 6 and 7.

The auxiliary tank 50 has an outer housing 56*a* in the form of a generally rectangular parallelepiped having a front opening (open on the right side as seen in FIG. 6B), and an outer lid 56*b* closing the front opening. The outer lid 56*b* is fitted at its periphery to the front end faces of the outer housing 56*a*, and fixed thereto by suitable fixing means, as shown in FIG. 6B. An inner housing 57*a* is enclosed within a space defined by the outer housing 56*a* and the outer lid 56*b*. The inner housing 57*a* also has a front opening which is open in one direction (in the right direction as seen in FIG. 6B) and which is closed by an inner lid 57*b* in the form of a film. The inner lid 57*b* is fusion-welded at its periphery to the front end faces of the inner housing 57*a*. The inner lid 57*b* in the form of the film has a lower degree of rigidity than the inner housing 57*a*. For example, the film of the inner lid 57*b* is formed of a material having a lower degree of rigidity than the material of the inner housing 57*a*, or the film formed of the same material as that of the inner housing 57*a* has a smaller thickness than the wall thickness of the inner housing 57*a*.

A cylindrical sleeve 57*c* extends from the upper wall of the inner housing 57*a* such that the sleeve 57*c* is contiguous with the projecting sleeve 50*b*, for communication of the projecting sleeve 50*b* with a space defined by the inner housing 57*a* and the inner lid 57*b*, as shown in FIG. 6B. Accordingly, the space defined by the inner housing 57*a* and inner lid 57*b* is held in communication with the filter unit 2 through the sleeve 57*c*, projecting sleeve 50*b* and elastic tube 41 (shown in FIG. 2).

A cylindrical sleeve 50*e* extends from the upper wall of the outer housing 56*a* such that the sleeve 50*e* is contiguous with the projecting sleeve 50*c*, for communication of the projecting sleeve 50*c* with the space defined by the outer housing 56*a* and the outer lid 56*b*, as shown in FIG. 6A. Accordingly, the space defined by the outer housing 56*a* and outer lid 56*b* is held in communication with the filter unit 2 through the sleeve 50*e*, projecting sleeve 50*c* and elastic tube 42 (shown in FIG. 2). The lower end of the sleeve 50*e* is located above the inner surface of the lower wall of the outer housing 56*a*. During the circulation purging operation, the ink is returned from the filter unit 2 to a lower portion of the space defined by the outer housing 56*a* and outer lid 56*b*, through the elastic tube 42, projecting sleeve 50*c* and sleeve 50*e*.

The inner housing 57*a* has a rear wall (left side wall as seen in FIG. 6B) formed integrally with a rear wall of the outer housing 56*a*. For example, the outer housing 56*a*, inner housing 57*a*, sleeves 57*c*, 50*e* and projecting sleeves 50*a*-50*d* are formed integrally as a one-piece structure.

The auxiliary tank 50 constructed as described above has an outer liquid flow space in the form of an outer ink flow space 56 and an inner liquid flow space in the form of an inner ink flow space 57. The outer ink flow space 56 is a portion of the space defined by the outer housing 56*a* and outer lid 56*b*, which is other than the inner ink flow space 57 defined by the inner housing 57*a*, inner lid 57*b* and sleeve 57*c*. The inner ink flow space 57 is enclosed by the outer ink flow space 56. In other words, the inner ink flow space 57 is formed by an inner wall structure of the auxiliary tank 50 consisting of the inner housing 57*a*, inner lid 57*b* and sleeve 57*c*, and the inner wall structure is enclosed within an outer wall structure of the auxiliary tank 50 consisting of the outer housing 56*a* and outer lid 56*b*. The inner ink flow space 57 has an enlarged portion which is defined by the inner housing 57*a* and inner lid 57*b* and which has a larger cross sectional area of ink flow than that of a portion defined by the sleeve 57*c*.

The pump 50P is disposed in opposition to the inner housing 57*a*, with the lower wall of the outer housing 56*a* interposed therebetween, namely, located below the inner housing 57*a*. The pump 50P is a diaphragm pump having three cylinders. As shown in FIG. 6B, the pump 50*p* includes a housing 51, and a drive shaft 52*a*, a driving body 52*b* and three pistons 52*c* which are disposed within the housing 51. In FIG. 6B, only one piston 52*c* is shown. The housing 51 includes an upper portion 51*a* supporting the driving body 52*b*, and a lower portion 51*b* fixed to the lower end of the upper portion 51*a*. A motor (not shown) is disposed below the housing 51 such that an output shaft 50M extends through the lower portion 51*b* into an interior space of the housing 51. The drive shaft 52*a* is fixed to the upper end portion of the output shaft 50M, at a position radially offset with respect to the axis of rotation of the output shaft 50M, such that the drive shaft 52*a* is inclined with respect to the axis of the output shaft 50M. The driving body 52*b* has a shaft portion into which the drive shaft 52*a* is partially inserted, and arms extending from the upper end of the shaft portion in the radial direction of the shaft portion. The upper portion 51*a* of the housing 51 has a protrusion 51*a*1 extending downwards from its upper wall, and the shaft portion of the driving body 52*b* is held at its upper end in abutting contact with the protrusion 51*a*1. The driving body 52*b* is supported by the drive shaft 52*a* such that the driving body 52*v* is freely rotatable. The pistons 52*c* are attached to the respective arms of the driving body 52*b*.

Three pump chambers 53 are formed between the respective pistons 52*c* and the lower wall of the auxiliary tank 50 (lower wall of the outer housing 56*a*). The three pump chambers 53 are held in communication with the outer ink flow space 56 through respective through-holes formed through the lower wall of the outer housing 56*a*, and in communication with the inner ink flow space 57 through respective through-holes formed through the lower wall of the inner housing 57*a*. Each of the through-holes in the outer housing 56*a* is provided with a check valve 54*a*, while each of the through-holes in the inner housing 57*a* is provided with a check valve 54*b*. Namely, the three through-holes formed through the lower wall of the inner housing 57*a* function as outlets through which the ink is delivered from the pump 50P into the inner ink flow space 57. The inner liquid flow space in the form of the inner ink flow space 57 is held in communication with the liquid supply portion in the form of the pump 50P through the above-indicated outlet.

The pump 50P is driven to perform the purging operations, under the control of the controller 1*p* (shown in FIG. 1). During the purging operations, a rotary motion of the motor output shaft 50M causes a rotary motion of the drive shaft 52*a* in its inclined posture, and a consequent oscillatory motion of the shaft portion of the driving body 52*b* at its upper end, and vertical reciprocal motions of the three arms of the driving body 52*b* in mutually different phases, resulting in expansion and contraction of the three pump chambers 53 in mutually different phases. With this operation of the pump 50P, three ink flow paths X are alternately established for the respective three pump chambers 53, as indicated by arrows in FIG. 6B. Each ink flow path X formed as a liquid flow path extends from the outer ink flow space 56 to the filter unit 2 through the pump chamber 53 and inner ink flow space 57. The ink pressure within the inner ink flow space 57 is higher than that within the outer ink flow space 56.

In the printer 1 constructed as described above, the auxiliary tank 50 includes the outer wall structure 56*a*, 56*b* defining the outer ink flow space 56, and the inner wall structure 57*a*, 57*b*, 57*c* which is enclosed within the outer wall structure and which defines therein the inner ink flow space 57 communicating with the liquid supply portion in the form of the pump 50P. In this construction, a leakage of the ink from the inner ink flow space 57 as a result of damage or destruction of at least one of the inner housing 57*a*, inner lid 57*b* and sleeve 57*c* due to an excessively high pressure of the ink within the inner ink flow space 57 will not cause a leakage of the ink from the auxiliary tank 50. That is, the leakage of the ink from the auxiliary tank 50 is effectively prevented owing to the outer ink flow space 56 formed outside of the inner ink flow space 57 in which the ink pressure is comparatively high.

In the printer 1 of the illustrated embodiment, the inner lid 57*b* of the inner wall structure which consists of the inner housing 57*a*, inner lid 57*b* and sleeve 57*c* which defines the inner ink flow space 57 is constituted by the film which has a damping effect to prevent an abrupt change of the ink pressure within the inner ink flow space 57 due to pressure pulsation of the pump 50P.

Further, the inner lid 57*b* of the inner wall structure is fusion-welded to the inner housing 57*a*. The fusion welding of the inner lid 57*b* to the inner housing 57*a* is relatively easy, but the reliability of the bonding strength of the fusion weld is relatively low. However, the provision of the outer ink flow space 56 is effective to prevent a leakage of the ink from the auxiliary tank 50 even in the even of breakage or destruction of the fusion weld between the inner lid 57*b* and the inner housing 57*a*. Although the fusion weld is likely to induce water evaporation, the provision of the outer ink flow space 56 exposed to the outer ink flow space 56 reduces a risk of the water evaporation, and a consequent risk of increase of the viscosity of the ink.

In the present printer 1, the pump 50P is operated to supply the ink from the auxiliary tank 50 to the ink-jet heads 10 during the purging operation of the ink-jet heads 10. During the purging operation wherein the ink pressure within the auxiliary tank 50 is raised to a relatively high value, the wall structure of the auxiliary tank 50 has a risk of breakage or destruction, particularly where the ink-ejecting nozzles 14*a* are clogged with the ink or where the pressure pulsation of the pump 50*p* takes place. However, the double wall structure of the auxiliary tank 50 consisting of the outer wall structure defining the outer ink flow space 56 and the inner wall structure defining the inner ink flow space 57 effectively prevents the ink leakage from the auxiliary tank 50 during the purging operation.

Further, the pump 50P is fixed to the lower wall of the auxiliary tank 50 (the lower wall of the outer housing 56*a*), so that the printer 1 as a whole can be small-sized, and the printer 1 does not suffer from a problem of an undesirable rise of the viscosity of the ink due to water evaporation during a flow of the ink through a flow passage between the pump 50P and the auxiliary tank 50, which is relatively short in the present printer 1.

As shown in FIG. 6B, the outlet of the pump 50P communicates with the inner liquid flow space 57, for the ink to be delivery from the pump 50P into the inner liquid flow space 57. During the operation of the pump 50P, the pressure of the ink within the inner liquid flow space 57 is raised, giving rise to breakage or destruction of the inner wall structure consisting of the inner housing 57*a*, inner lid 57*b* and sleeve 57*c* which define the inner ink flow space 57. However, the ink leakage from the auxiliary tank 50 due to the breakage or destruction of the inner wall structure can be effectively prevented in the presence of the outer ink flow space 56.

In addition, the inner liquid flow space 57 has the enlarged portion which is defined by the inner housing 57*a* and inner lid 57*b* and which has a larger cross sectional area of flow of the ink than the other portion, and the pump 50*p* is the diaphragm pump having the three cylinders communicating with the outlets which communicates with the enlarged portion of the inner ink flow space 57. This diaphragm pump 50P does not suffer from considerable pressure pulsation and can be small-sized, while making it possible to effectively prevent the ink leakage from the auxiliary tank 50.

While the preferred embodiment of the present invention has been described above by reference to the drawings, for illustrative purpose only, it is to be understood that the present invention is not limited to the details of the illustrated embodiment, but may be embodied with various changes and modifications, which may occur to those skilled in the art, without departing from the spirit and scope of the invention defined in the appended claims.

The material and configuration of the inner wall structure of the auxiliary tank 50 which defines the inner ink flow space 57 are not limited to those in the illustrated embodiment. For example, the inner wall structure may include any member other than a film, such as a plate having a larger thickness than the film. Further, the above-indicated member such as the film or plate of the inner wall structure is not required to have a fusion-welded portion.

In the illustrated embodiment, the pump 50P provided as the liquid supply portion of the printer 1 is fixed to the lower wall of the auxiliary tank 50. However, the liquid supply portion may be located at any other position. For instance, the liquid supply portion may be fixed to the upper or side wall of the auxiliary tank 50. Further, the liquid supply portion need not be fixed to the outer wall structure of the auxiliary tank 50, but may be spaced apart from the auxiliary tank 50, and connected to the auxiliary tank 50 through a tube.

The diaphragm pump 50P may be replaced by any other type of pump, such as a tube pump and an impeller type pump.

In the illustrated embodiment, the principle of the present invention applies to the auxiliary tank 50 as a tank for storing a liquid to be supplied to a liquid-ejecting head. However, the principle of the invention is equally applicable to any other tank such as the main tank 39.

The structure defining the ink flow paths X as the liquid flow path and the inner ink flow space 56 as the inner liquid flow path may be modified as needed. For example, the inner lid 57*b* provided in the illustrated embodiment is eliminated, and the inner housing 57*a* is fusion-welded or otherwise bonded at its front end faces (defining the front opening) to the inner surface of the outer lid 56*b*. In this case, the dimension of the inner housing 57*a* in the direction perpendicular to the plane of view of FIG. 6A, that is, the dimension in the horizontal direction as seen in FIG. 6B is increased to that of the outer housing 56*a*. While the rear wall of the inner housing 57*a* is formed integrally with the rear wall of the outer housing 56*a* in the illustrated embodiment, the rear wall of the inner housing 57*a* may be spaced apart from the rear wall of the outer housing 56*a* so that the rear wall of the inner housing 57*a* is located within the outer ink flow space 56. This modification assures more effective prevention of ink leakage from the auxiliary tank 50.

The liquid ejecting apparatus according to the present invention is not limited to a printer, but may be a facsimile or coping apparatus. The liquid-ejecting head of the liquid ejecting apparatus of the present invention may be of either a line printing type or a serial printing type. The liquid-ejecting head may use a liquid other than an ink.

In the illustrated embodiment, the paper sheet P is used as a recording medium on which a printing operation is performed. However, the paper sheet P may be replaced by any other recording medium such as a fabric.

What is claimed is:

1. A liquid ejecting apparatus comprising:

a liquid-ejecting head configured to eject a liquid;

a tank which stores the liquid to be supplied to the liquid-ejecting head; and a liquid supply portion configured to supply the liquid from the tank to the liquid-ejecting head, wherein the tank includes an inner wall structure which is enclosed within an outer wall of the tank and which defines therein an inner liquid flow space which communicates with the liquid supply portion and through which the liquid is supplied from the liquid supply portion to the liquid-ejecting head, wherein the inner liquid flow space has an enlarged portion, and a downstream portion which has a smaller cross sectional area of flow of the liquid than the enlarged portion and which is located downstream of the enlarged portion as seen in a direction of flow of the liquid from the liquid supply portion toward the ink-ejecting head through the tank, and wherein the liquid supply portion has an outlet communicating with the enlarged portion.

2. The liquid ejecting apparatus according to claim 1, wherein at least a part of the inner wall structure consists of a wall in the form of a film which has a lower degree of rigidity than the other part of the inner wall structure.

3. The liquid ejecting apparatus according to claim 1, wherein the inner wall structure consists of a wall in the form of a film, and an inner housing having an opening which is open in one direction and which is closed by the wall in the form of the film, and the outer wall structure consists of an outer housing of a generally rectangular parallelepiped having an opening open in said one direction, and an outer lid closing the opening of the outer housing.

4. The liquid ejecting apparatus according to claim 1, wherein at least a part of a portion of the inner wall structure which defines the enlarged portion consists of a wall in the form of a film which has a lower degree of rigidity than the other part of the inner wall structure.

5. The liquid ejecting apparatus according to claim 1, wherein the inner wall structure includes an inner housing to which a wall in the form of a film is fusion-welded.

6. The liquid ejecting apparatus according to claim 1, wherein the liquid supply portion is operated to supply the liquid from the tank to the liquid-ejecting head during a purging operation of the liquid-ejecting head.

7. The liquid ejecting apparatus according to claim 1, wherein the liquid supply portion is a pump which is fixed to the outer wall structure and which is configured to supply the liquid to the liquid-ejecting head.

8. The liquid ejecting apparatus according to claim 7, wherein the pump has an outlet which communicates with the inner liquid flow space and through which the liquid is delivered from the pump into the inner liquid flow space.

9. A liquid ejecting apparatus comprising:

a liquid-ejecting head configured to eject a liquid;

a tank which stores the liquid to be supplied to the liquid-ejecting head; and a liquid supply portion configured to supply the liquid from the tank to the liquid-ejecting head, wherein the tank includes an inner wall structure which is enclosed within an outer wall of the tank and which defines therein an inner liquid flow space which communicates with the liquid supply portion and through which the liquid is supplied from the liquid supply portion to the liquid-ejecting head, wherein the liquid supply portion is a pump which is fixed to the outer wall structure and which is configured to supply the liquid to the liquid-ejecting head, wherein the pump has an outlet which communicates with the inner liquid flow space and through which the liquid is delivered from the pump into the inner liquid flow space, and wherein the inner liquid flow space has an enlarged portion having a larger cross sectional area of flow of the liquid than the other portion, and the pump is a diagram pump having a plurality of cylinders each of which communicates with the outlet communicating with the enlarged portion.

* * * * *